US009666982B1

(12) United States Patent
Luksic

(10) Patent No.: US 9,666,982 B1
(45) Date of Patent: May 30, 2017

(54) ELECTRICAL CONNECTOR HAVING LATCH RELEASE COLLAR

(71) Applicant: TYCO ELECTRONICS CORPORATION, Berwyn, PA (US)

(72) Inventor: Marek Tadeusz Luksic, Dillsburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/137,727

(22) Filed: Apr. 25, 2016

(51) Int. Cl.

| | |
|---|---|
| ***H01R 13/627*** | (2006.01) |
| ***H01R 13/635*** | (2006.01) |
| ***H01R 13/639*** | (2006.01) |
| *H01R 107/00* | (2006.01) |

(52) U.S. Cl.
CPC ..... *H01R 13/6278* (2013.01); *H01R 13/635* (2013.01); *H01R 13/6395* (2013.01); *H01R 2107/00* (2013.01)

(58) Field of Classification Search
CPC ..... H01R 2107/00; H01R 13/6278; H01R 13/635; H01R 13/6395
See application file for complete search history.

(56) References Cited

U.S. PATENT DOCUMENTS

| | | | | |
|---|---|---|---|---|
| 5,299,983 | A * | 4/1994 | Pfost | A63D 15/083 473/45 |
| 2007/0082534 | A1* | 4/2007 | Wada | H01R 9/032 439/352 |
| 2008/0214040 | A1* | 9/2008 | Holterhoff | H01R 13/6277 439/352 |
| 2011/0136369 | A1* | 6/2011 | Dang | H01R 4/18 439/352 |
| 2015/0047898 | A1* | 2/2015 | Sagdic | H01R 13/506 174/657 |
| 2015/0361738 | A1* | 12/2015 | Angelle | E21B 19/07 166/380 |

* cited by examiner

*Primary Examiner* — Jean F Duverne

(57) ABSTRACT

An electrical connector includes a circular housing having a cavity configured to receive a mating connector. The housing holds power terminals in the cavity. The housing has a mating end having a generally circular cross-section. The housing has a flexible latch at the mating end configured to engage a latch of the mating connector. The flexible latch has a pull hook extending therefrom. A release collar is slidably coupled to the housing at the mating end in an axial direction between a forward position and a rearward position. The release collar has an actuator ramp facing the pull hook. The actuator ramp engages the pull hook to actuate the flexible latch to release the flexible latch from a latch of the mating connector as the release collar is moved in the axial direction to the rearward position.

20 Claims, 5 Drawing Sheets

ELECTRICAL CONNECTOR HAVING LATCH RELEASE COLLAR

BACKGROUND OF THE INVENTION

The subject matter herein relates generally to electrical connectors having latch release collars.

Electrical connectors, such as power connectors, commonly have latches or other securing means to secure the electrical connectors together. For example, plug connectors have a static latch extending therefrom and socket connectors have a deflectable latch extending therefrom. However, the latches make the designs more complicated, costly and/or bulkier. Additionally, to uncouple the connectors, a separate tool is often required to release the flexible latch member to disengage the latches and allow uncoupling.

A need remains for an electrical connector having an integrated latch release feature for uncoupling the electrical connector from a mating connector.

BRIEF DESCRIPTION OF THE INVENTION

In one embodiment, an electrical connector is provided including a circular housing having a cavity configured to receive a mating connector. The housing holds power terminals in the cavity. The housing has a mating end having a generally circular cross-section. The housing has a flexible latch at the mating end configured to engage a latch of the mating connector. The flexible latch has a pull hook extending therefrom. A release collar is slidably coupled to the housing at the mating end in an axial direction between a forward position and a rearward position. The release collar has an actuator ramp facing the pull hook. The actuator ramp engages the pull hook to deflect the flexible latch to release the flexible latch from a latch of the mating connector as the release collar is moved in the axial direction to the rearward position.

In another embodiment, an electrical connector is provided including a housing having a cavity configured to receive a mating connector. The housing holds power terminals in the cavity. The housing has a mating end having a generally circular cross-section. The housing has a flange rearward of the mating end. The housing has a flexible latch at the mating end configured to engage a latch of the mating connector. The flexible latch has a pull hook extending therefrom. A release collar is slidably coupled to the housing at the mating end in an axial direction between a forward position and a rearward position. The release collar has a front end and a rear end opposite the front end. The release collar has a spring between the rear end and the flange. The spring biases the release collar to the forward position. The release collar is movable in a rearward direction to the rearward position against the spring bias to release the flexible latch. The release collar has an actuator ramp facing the pull hook. The actuator ramp engages the pull hook to actuate the flexible latch to release the flexible latch from a latch of the mating connector as the release collar is moved to the rearward position.

In a further embodiment, an electrical connector system is provided including a plug connector and a socket connector mated with the plug connector. The plug connector includes a plug housing including a static latch at a mating end of the plug housing. The plug housing holds power terminals. The plug housing has a generally circular cross-section at the mating end. The socket connector has a socket housing with a cavity configured to receive the mating end of the plug connector. The socket housing holds power terminals in the cavity mated with the power terminals of the plug connector. The socket housing has a mating end having a generally circular cross-section. The socket housing has a flexible latch at the mating end configured to engage the latch of the plug connector with a pull hook extending therefrom. The socket connector has a release collar slidably coupled to the socket housing at the mating end in an axial direction between a forward position and a rearward position. The release collar has an actuator ramp facing the pull hook. The actuator ramp engages the pull hook to actuate the flexible latch to release the flexible latch from the latch of the plug connector as the release collar is moved to the rearward position.

DETAILED DESCRIPTION OF THE INVENTION

Figure 1:
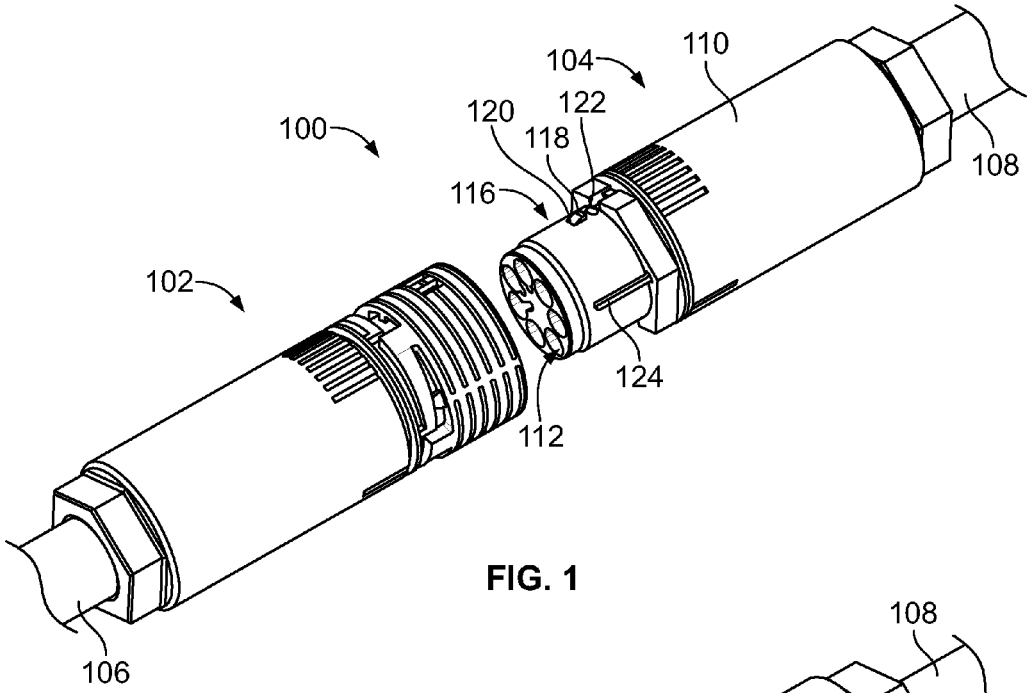
FIG. 1 is a perspective view of an electrical connector system formed in accordance with an exemplary embodiment showing first and second electrical connectors poised for mating.
Figure 2:
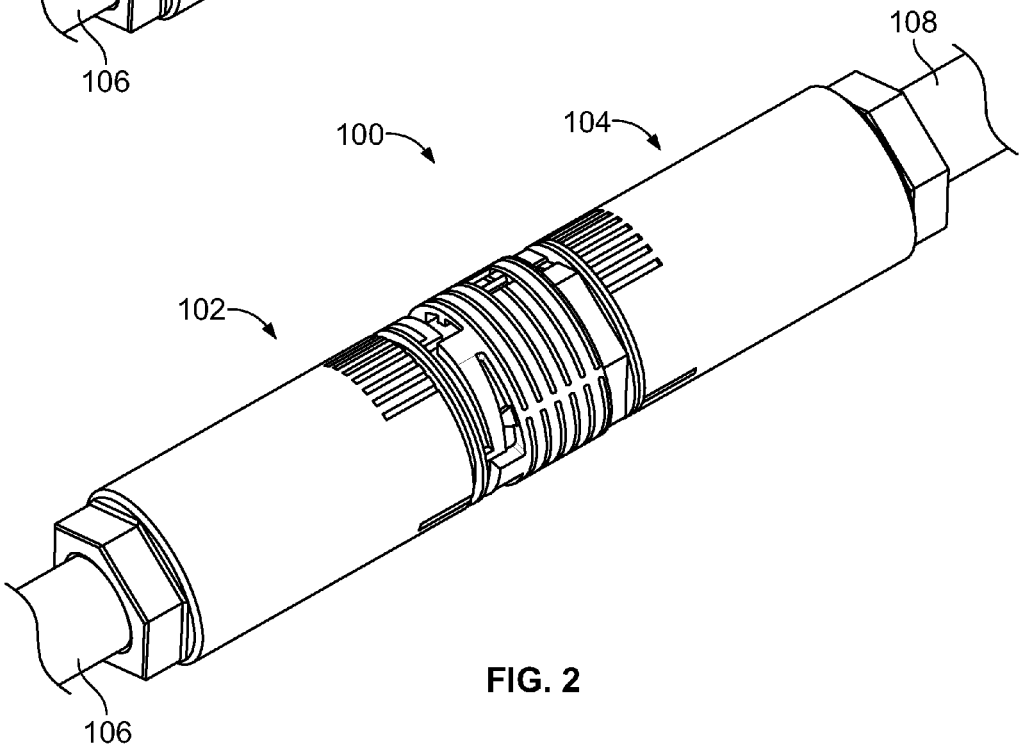
FIG. 2 is a perspective view of the electrical connector system showing the first and second electrical connectors mated together.
Figure 3:
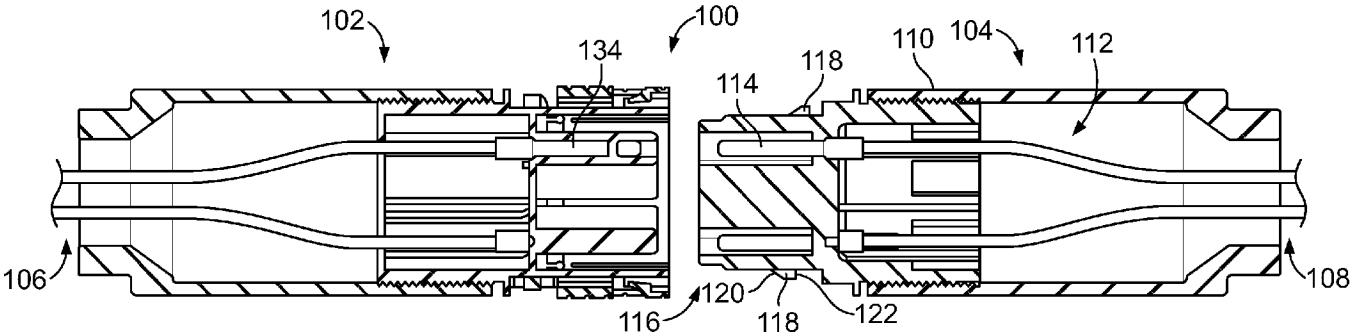
FIG. 3 is a cross-sectional view of the first and second electrical connectors.

FIG. 1 is a perspective view of an electrical connector system 100 formed in accordance with an exemplary embodiment showing first and second electrical connectors poised for mating. FIG. 2 is a perspective view of the electrical connector system 100 showing the first and second electrical connectors 102, 104 mated together. FIG. 3 is a cross-sectional view of the first and second electrical connectors 102, 104. Either of the electrical connectors 102 or 104 may be considered a mating connector 102 or 104 for the other electrical connector.

In the illustrated embodiment, the electrical connector 102 is a socket connector and may be referred to hereinafter as a socket connector 102 while the second electrical connector 104 is a plug connector and may be referred to as a plug connector 104 hereinafter. The socket connector 102 receives a mating end of the plug connector 104. In the illustrated embodiment, both electrical connectors 102, 104 are provided at ends of corresponding cables 106, 108. In an exemplary embodiment, the cables 106, 108 are power cables providing power to the electrical connectors 102, 104. The electrical connectors 102, 104 thus define power connectors and the electrical connector system 100 is a power connector system. However, the electrical connectors 102, 104 may transmit data signals in addition to or in the alternative to transmitting power. The cables 106, 108 may have individual wires terminated to corresponding terminals, such as power terminals, in the electrical connectors 102, 104.

The plug connector 104 includes a housing 110 having a cavity 112. The housing 110 holds a plurality of terminals 114 in the cavity 112. The wires of the cable 108 are terminated to corresponding terminals 114 within the cavity 112. The housing 110 has a mating end 116 opposite the cable end of the plug connector 104. In an exemplary embodiment, the housing 110 is a circular housing. The mating end 116 has a generally circular cross-section; however, the housing 110 may have other shapes in alternative embodiments. The terminals 114 are arranged circumferentially around the cavity 112 near the exterior of the housing 110; however the terminals 114 may have a different arrangement in alternative embodiments.

The plug connector 104 includes a latch 118 at the mating end 116 that is used for latching engagement with the socket connector 102. In the illustrated embodiment, the latch 118 is a static latch. Optionally, multiple latches 118 may be provided, such as on opposite sides of the housing 110. In the illustrated embodiment, the latch 118 includes a forward facing ramp surface 120 and a rear facing catch surface 122. The socket connector 102 includes a flexible latch configured to engage the latch 118 and is configured to be secured to the catch surface 122 to secure the socket connector 102 to the plug connector 104.

In an exemplary embodiment, the plug connector 104 includes guide features 124 to guide mating with the socket connector 102. In the illustrated embodiment, the guide features 124 are ribs extending along the exterior surface of the housing 110 at the mating end 116. Other types of guide features may be provided in alternative embodiments. The guide features 124 may provide keyed mating with the socket connector 102.

In an exemplary embodiment, the socket connector 102 includes a slidable release collar to release the flexible latches of the socket connector 102 from the latches 118 of the plug connector 104. The slidable release collar allows for tool-less releasing or tool-less delatching of the flexible latches. In alternative embodiments, the release collar may be provided on the plug connector 104 rather than the socket connector 102.

Figure 4:
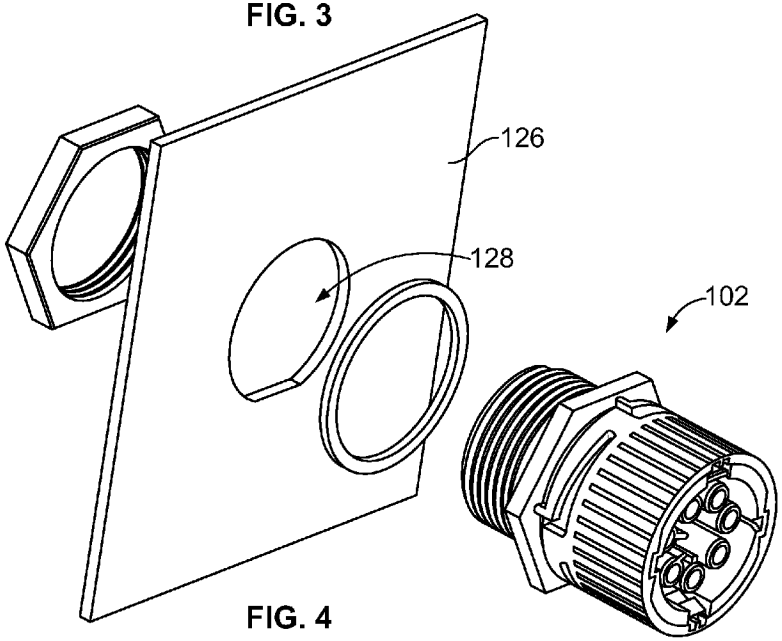
FIG. 4 is an exploded perspective view of a portion of the electrical connector system showing the socket connector in accordance with an exemplary embodiment.

FIG. 4 is an exploded perspective view of a portion of the electrical connector system 100 showing the socket connector 102 in accordance with an exemplary embodiment. In the illustrated embodiment, the socket connector 102 is configured to be mounted to a panel 126. The socket connector 102 passes through an opening 128 in the panel 126 and is secured to the panel 126 using a threaded coupling, such as a threaded nut received on external threads of the socket connector 102.

Figure 5:
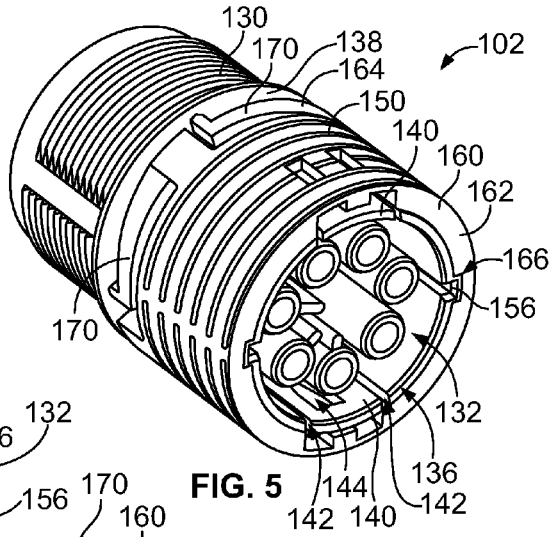
FIG. 5 is a front perspective view of a socket connector of the electrical connector system in an assembled state.
Figure 6:
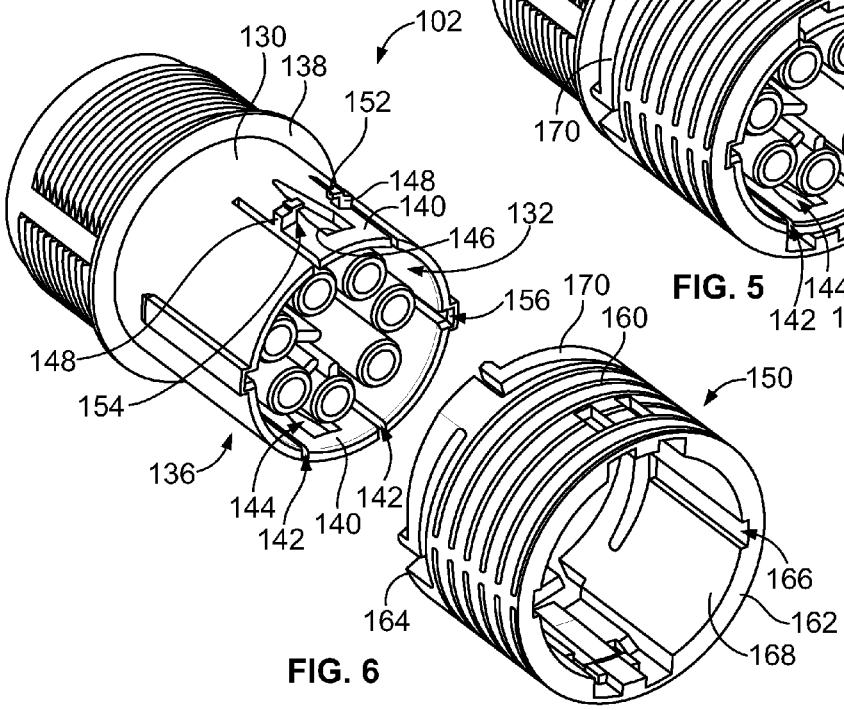
FIG. 6 is an exploded view of the socket connector.
Figure 7:
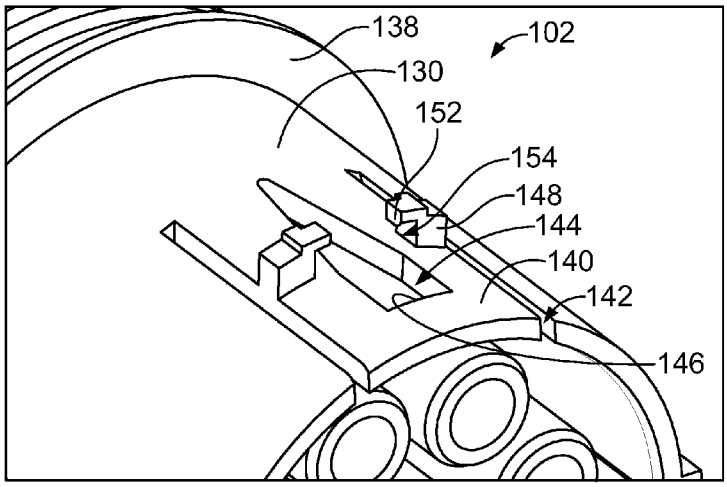
FIG. 7 is an enlarged view of a portion of the socket connector.

FIG. 5 is a front perspective view of the socket connector 102 in an assembled state. FIG. 6 is an exploded view of the socket connector 102. FIG. 7 is an enlarged view of a portion of the socket connector 102.

The socket connector 102 includes a housing 130 having a cavity 132 configured to receive a mating connector, such as the plug connector 104 (shown in FIG. 1). The housing 130 holds a plurality of terminals 134 (shown in FIG. 3) configured to be mated with corresponding terminals 114 (shown in FIG. 3) of the plug connector 104. In an exemplary embodiment, the terminals 134 are power terminals terminated to corresponding wires of the cable 106 (shown in FIG. 1). The housing 130 includes a mating end 136 generally opposite the cable end. In the illustrated embodiment, the housing 130 is a circular housing. The mating end 136 has a generally circular cross-section; however, the housing 130 may have other shapes in alternative embodiments. In an exemplary embodiment, the housing 130 includes a flange 138 rearward of the mating end 136.

The housing 130 includes flexible latches 140 configured to be latchably secured to corresponding latches 118 (shown in FIG. 1). In the illustrated embodiment, the housing 130 includes two flexible latches 140 on opposite sides of the housing 130; however, any number of flexible latches 140 may be provided in alternative embodiments. The flexible latches 140 have slots 142 on opposite sides of the flexible latch 140 allowing the flexible latch 140 to be deflected and released during latching and unlatching from the latch 118. The flexible latch 140 includes on opening 144 configured to receive the latch 118. The opening 144 may have any shape to receive the latch 118. In the illustrated embodiment, the opening 144 is defined at a front end thereof by a catch surface 146 configured to engage the catch surface 122 of the latch 118. The opening 144 may be elongated to make the flexible latch 140 more flexible.

In an exemplary embodiment, the flexible latch 140 includes one or more pull hooks 148 extending radially outward from the flexible latch 140. The pull hooks 148 are used to release the flexible latches 140. In the illustrated embodiment, the pull hooks 148 are approximately centered axially along the flexible latch 140; however, the pull hooks 148 may be provided at any location along the flexible latches 140, such as near the front end or near the rear end of the flexible latch 140. The pull hooks 148 may have any shape that facilitate interaction and release by a release collar 150 of the socket connector 102. In the illustrated embodiment, the pull hook 148 includes an overhang 152 with an undercut 154 defined between the overhang 152 and the exterior surface of the flexible latch 140. A portion of the release collar 150 is configured to be received in the undercut 154 and interacts with the overhang 152 to release the flexible latch 140 when the release collar 150 is actuated. In the illustrated embodiment, the pull hooks 148 are separate from each other; however, the pull hooks 148 may be connected in alternative embodiments, such as with a common overhang 152 defining a common undercut 154.

In an exemplary embodiment, the housing 130 includes one or more guide features 156 that interact with the guide features 124 (shown in FIG. 1) to guide mating of the socket connector 102 and the plug connector 104. In the illustrated embodiment, the guide features 156 are configured to receive the rib-shaped guide features 124 of the plug connector 104. For example, the guide features 156 are closed to define channels; however, the guide features may be open in alternative embodiments defining slots configured to receive the rib-shaped guide features 124. In an exemplary embodiment, the guide features 156 are configured to interact with the release collar 150 to guide mating and actuation of the release collar 150 relative to the housing 130. For example, the guide features 156 may prevent rotation of the release collar 150 and maintain alignment of the release features of the release collar 150 with the pull hooks 148.

The release collar 150 includes a ring-shaped body 160 configured to be received over the mating end 136 of the housing 130. The release collar 150 extends between a front end 162 and a rear end 164. The body 160 includes guide features 166 extending axially along an interior surface 168 thereof. The guide features 166 interact with the guide features 156 of the housing 130 to guide mating with the housing 130 and to orient the release collar 150 relative to the housing 130. In the illustrated embodiment, the guide features 166 are channels that receive the guide features 156; however, other types of guide features may be provided in alternative embodiments. Optionally, the guide features 166 may guide movement of the release collar 150 relative to the housing 130. For example, the guide features 166 may limit movement of the release collar 150 to axial translational movement, such as during actuation of the release collar 150. The guide features 166 may limit or restrict rotational movement of the release collar 150 relative to the housing 130.

In an exemplary embodiment, the release collar 150 includes springs 170 at the rear end 164. The springs 170 engage the flange 138 of the housing 130 to hold the release collar 150 at a forward position relative to the housing 130. For example, the springs 170 may be biased against the flange 138 to push the release collar 150 in a forward axial direction to the forward position. The release collar 150 is slidably coupled to the housing 130 at the mating end 136 in an axial direction between the forward position and a rearward position. For example, the release collar 150 may be slid rearward from the forward position to the rearward position against the bias of the springs 170. The rearward movement of the release collar 150 relative to the housing 130 causes the release collar 150 to actuate and release the flexible latches 140.

In an exemplary embodiment, the release collar 150 includes actuator ramps 180 that are configured to interact with corresponding pull hook 148 on the flexible latches 140 to actuate and release the flexible latches 140. The actuator ramps 180 may be wedged under the pull hooks 148 as the release collar 150 is slid rearward to force the flexible latches 140 to spread outward and release from the latches 118. The actuator ramps 180 extended inward from the interior surface 168. The actuator ramps 180 are axially aligned with the pull hooks 148 and are configured to engage the pull hooks 148 when the release collar 150 is pulled rearward.

Figure 8:
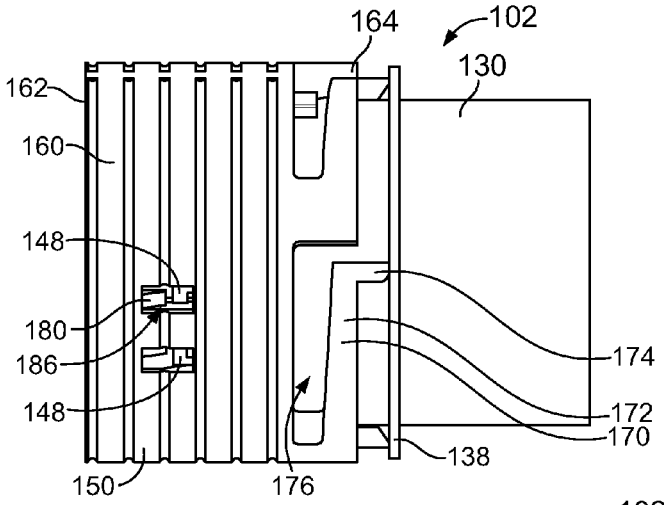
FIG. 8 is a side view of the socket connector showing a release collar thereof in a forward position.
Figure 9:
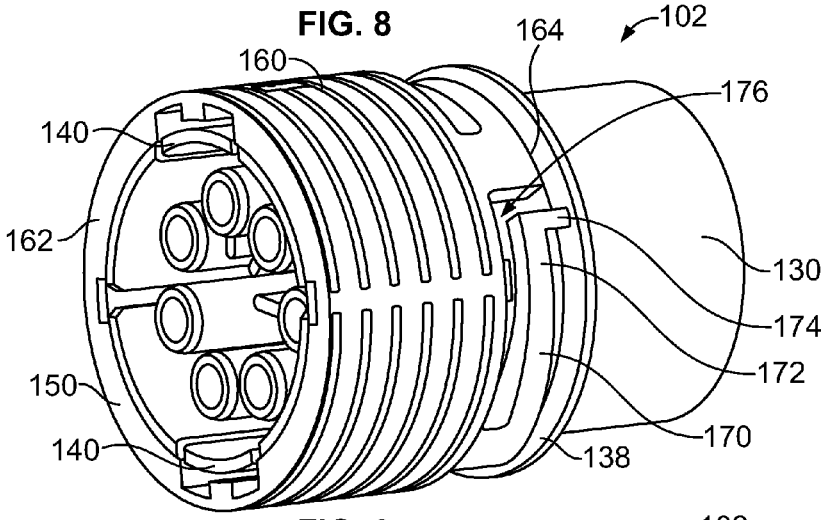
FIG. 9 is a front perspective view of the socket connector showing the release collar in the forward position.
Figure 10:
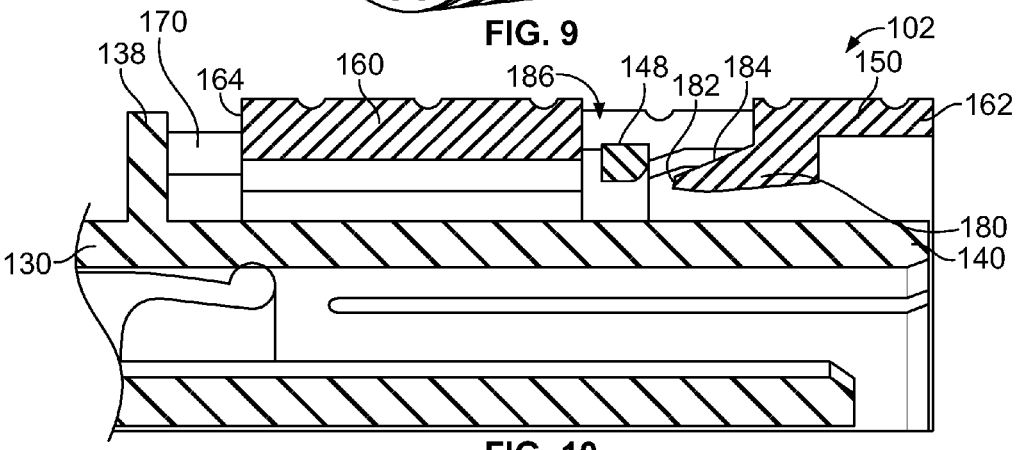
FIG. 10 is a cross-sectional view of a portion of the socket connector showing the release collar in the forward position.

FIG. 8 is a side view of the socket connector 102 showing the release collar 150 in the forward position. FIG. 9 is a front perspective view of the socket connector 102 showing the release collar 150 in the forward position. FIG. 10 is a cross-sectional view of a portion of the socket connector 102 showing the release collar 150 in the forward position.

The springs 170 engage the flange 138 to hold the release collar 150 in the forward position. In an exemplary embodiment, the springs 170 are integral with the body 160 of the release collar 150. Alternatively, a separate spring or springs 170 may be provided between the flange 138 and the rear end 164 of the body 160. In the illustrated embodiment, the springs 170 have spring arms 172 extending in a circumferential direction at least partially around the housing 130. The springs 170 have spring fingers 174 extending from the spring arms 172 to engage the flange 138. The body 160 includes relief pockets 176 at the rear end 164 aligned with the springs 170. The relief pockets 176 receive the corresponding springs 170 when the release collar 150 is slid rearward. The springs 170 bias the release collar 150 to the forward position. Optionally, in the forward position, the front end 162 of the release collar 150 may be generally flush with the front of the housing 130; however, the front end 162 may be positioned forward or rearward of the front of the housing 130 in alternative embodiments.

In the forward position, the actuator ramp 180 is aligned axially forward of the pull hook 148 on the corresponding flexible latch 140. Optionally, the actuator ramp 180 is disengaged from the pull hook 148 in the forward position. For example, the actuator ramp 180 is forward of the pull hook 148 in the forward position. Alternatively, the actuator ramp 180 may engage the pull hook 148 in the forward position.

The actuator ramp 180 extends to a distal end 182 and includes a ramp surface 184 that is configured to engage the pull hook 148. In an exemplary embodiment, the release collar 150 includes an opening 186 radially outward of the actuator ramp 180. The opening 186 is configured to receive the pull hook 148. For example, when the actuator ramp 180 engages the pull hook 148 and forces the pull hook 148 outward, the pull hook 148 is received in the opening 186. Optionally, the ramp surface 184 and/or the forward facing surface of the pull hook 148 may be curved to provide a lead-in and to reduce the risk of binding the actuator ramp 180 against the pull hook 148 when the release collar 150 is slid rearward.

Figure 11:
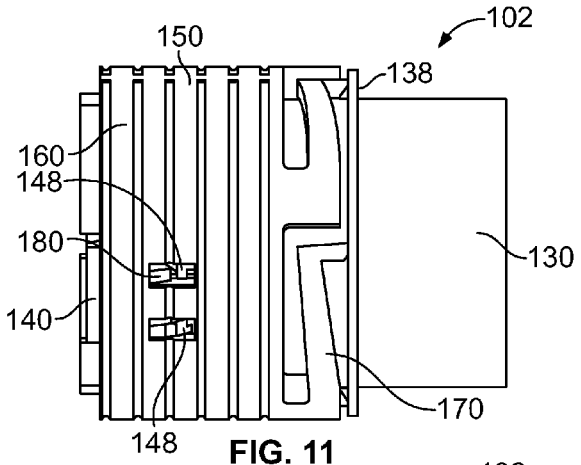
FIG. 11 is a side view of the socket connector showing the release collar in a rearward position.
Figure 12:
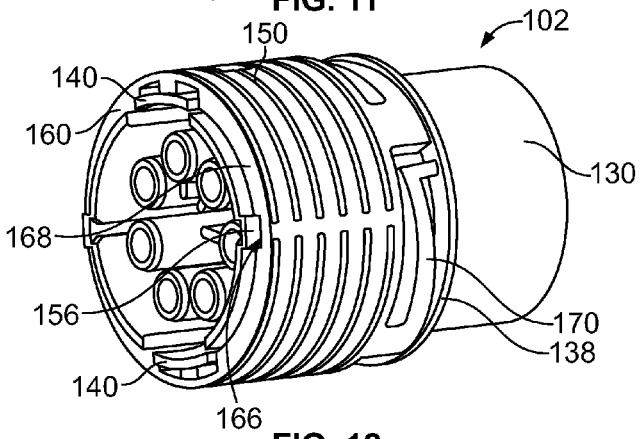
FIG. 12 is a front perspective view of a socket connector showing the release collar in the rearward position.
Figure 13:
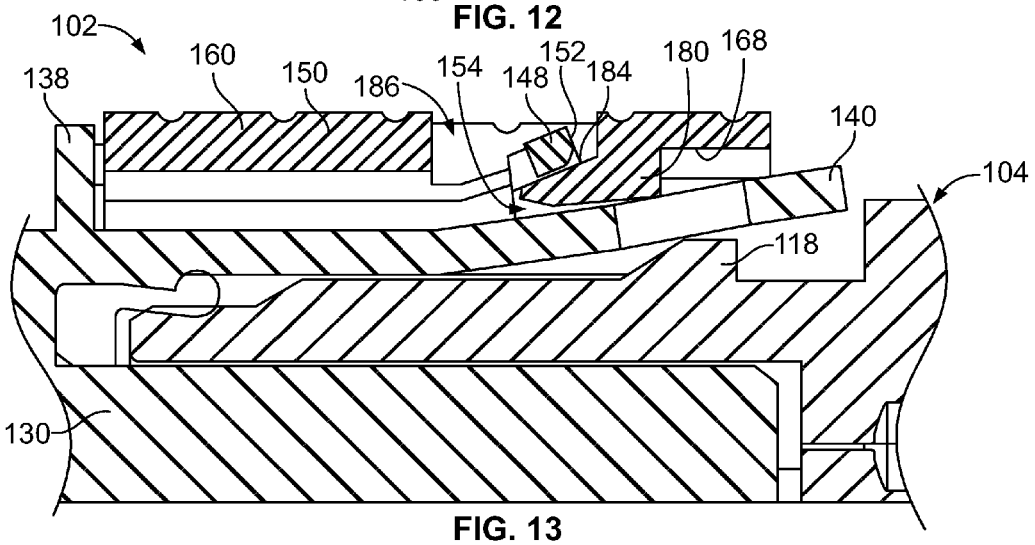
FIG. 13 is a cross-sectional view of a portion of the socket connector and a plug connector of the electrical connector system showing the release collar in the rearward position.

FIG. 11 is a side view of the socket connector 102 showing the release collar 150 in the rearward position. FIG. 12 is a front perspective view of a socket connector 102 showing the release collar 150 in the rearward position. FIG. 13 is a cross-sectional view of a portion of the socket connector 102 and the plug connector 104 showing the release collar 150 in the rearward position. The flexible latch 140 is shown released from the corresponding latch 118 (FIG. 13).

During use, the release collar 150 is moved axially rearward to release the flexible latches 140, such as from the latches 118. The guide features 156 interact with the guide features 166 to guide movement of the release collar 150 relative to the housing 130 in the axial direction, such as to prevent rotation of the release collar 150 and maintain alignment of the actuator ramp 180 with the pull hooks 148 of the flexible latches 140. The springs 170 are deflected against the flange 138 when the release collar 150 is moved rearward. As the release collar 150 is moved rearward, the actuator ramp 180 engages the pull hook 148 to force the pull hook 148, and thus the flexible latch 140 radially outward as the release collar 150 and the actuator ramp 180 are slid rearward to the rearward position. The actuator ramp 180 is received in the undercut 154 between the overhang 152 and the flexible latch 140. The overhang 152 engages the ramp surface 184 and rides along the ramp surface 184 to progressively force the flexible latch 140 to move radially outward as the release collar 150 is moved axially rearward. The actuator ramp 180 extends inward from the interior surface 168 of the body 160 and faces the exterior surface of the housing 130. The pull hook 148, such as the overhang 152, is received in the space between the actuator ramp 180 and the interior surface 168. As the actuator ramp 180 drives the pull hook 148 and flexible latch 140 outward, the pull hook 148 is at least partially received in the opening 186 as the pull hook 148 and the flexible latch 140 are released from the latch 118.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc., are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a circular housing having a cavity configured to receive a mating connector, the housing holding power terminals in the cavity, the housing having a mating end having a generally circular cross-section, the housing having a flexible latch at the mating end configured to engage a latch of the mating connector, the flexible latch having a pull hook extending therefrom; and a release collar slidably coupled to the housing at the mating end in an axial direction between a forward position and a rearward position, the release collar having an actuator ramp facing the pull hook, the actuator ramp engaging the pull hook to actuate the flexible latch to release the flexible latch from a latch of the mating connector as the release collar is moved in the axial direction to the rearward position.

2. The electrical connector of claim 1, wherein the actuator ramp is disengaged from the pull hook in the forward position.

3. The electrical connector of claim 1, wherein the actuator ramp forces the pull hook and the flexible latch radially outward as the release collar and the actuator ramp are slid rearward to the rearward position.

4. The electrical connector of claim 1, wherein the actuator ramp is positioned radially interior of the pull hook.

5. The electrical connector of claim 1, wherein the pull hook includes an overhang with an undercut defined between the overhang and the flexible latch, the actuator ramp being received in the undercut between the overhang and the flexible latch.

6. The electrical connector of claim 1, wherein the release collar includes an interior surface facing an exterior of the housing, the actuator ramp extending inward from the interior surface, the pull hook being received in the space between the actuator ramp and the interior surface.

7. The electrical connector of claim 1, wherein the release collar includes an opening aligned with the actuator ramp, the pull hook being at least partially received in the opening as the pull hook and the flexible latch are released.

8. The electrical connector of claim 1, wherein the release collar includes a spring between the release collar and the housing, the spring biasing the release collar to the forward position.

9. The electrical connector of claim 8, wherein the spring is integral with the release collar.

10. The electrical connector of claim 8, wherein the release collar includes a relief pocket between a rear end of the release collar and the spring, the relief pocket receiving the spring when the release collar is slid rearward.

11. The electrical connector of claim 1, wherein the housing includes a guide feature extending axially, the release collar including a guide feature interfacing with the guide feature of the housing to maintain alignment of the actuator ramp and the pull hook.

12. An electrical connector comprising:

a housing having a cavity configured to receive a mating connector, the housing holding power terminals in the cavity, the housing having a mating end having a generally circular cross-section, the housing having a flange rearward of the mating end, the housing having a flexible latch at the mating end configured to engage a latch of the mating connector, the flexible latch having a pull hook extending therefrom; and a release collar slidably coupled to the housing at the mating end in an axial direction between a forward position and a rearward position, the release collar having a front end and a rear end opposite the front end, the release collar having a spring between the rear end and the flange, the spring biasing the release collar to the forward position, the release collar being movable in a rearward direction to the rearward position against the spring bias to release the flexible latch, the release collar having an actuator ramp facing the pull hook, the actuator ramp engaging the pull hook to actuate the flexible latch to release the flexible latch from a latch of the mating connector as the release collar is moved to the rearward position.

13. The electrical connector of claim 12, wherein the actuator ramp is disengaged from the pull hook in the forward position.

14. The electrical connector of claim 12, wherein the actuator ramp forces the pull hook and the flexible latch radially outward as the release collar and the actuator ramp are slid rearward to the rearward position.

15. The electrical connector of claim 12, wherein the actuator ramp is positioned radially interior of the pull hook.

16. The electrical connector of claim 12, wherein the pull hook includes an overhang with an undercut defined between the overhang and the flexible latch, the actuator ramp being received in the undercut between the overhang and the flexible latch.

17. The electrical connector of claim 12, wherein the spring is integral with the release collar.

18. An electrical connector system comprising:

a plug connector having a plug housing including a static latch at a mating end of the plug housing, the plug housing holding power terminals, the plug housing having a generally circular cross-section at the mating end; and a socket connector having a socket housing having a cavity configured to receive the mating end of the plug connector, the socket housing holding power terminals in the cavity mated with the power terminals of the plug connector, the socket housing having a mating end having a generally circular cross-section, the socket housing having a flexible latch at the mating end configured to engage the latch of the plug connector, the flexible latch having a pull hook extending therefrom, the socket connector having a release collar slidably coupled to the socket housing at the mating end in an axial direction between a forward position and a rearward position, the release collar having an actuator ramp facing the pull hook, the actuator ramp engaging the pull hook to actuate the flexible latch to release the flexible latch from the latch of the plug connector as the release collar is moved to the rearward position.

19. The electrical connector system of claim 18, wherein the actuator ramp forces the pull hook and the flexible latch radially outward as the release collar and the actuator ramp are slid rearward to the rearward position.

20. The electrical connector system of claim 18, wherein the actuator ramp is positioned radially interior of the pull hook.

* * * * *